US005313049A

United States Patent [19]

Le Strat et al.

[11] Patent Number: 5,313,049

[45] Date of Patent: May 17, 1994

[54] COOKING TOP COVER WITH MOTORIZED RETRACTABLE CLOSURE MEANS ASSEMBLY

[75] Inventors: Georges Le Strat, Saint-Martin-Aux-Arbres; Michel Lefebvre, Rouen; Michel Emont, Moulineaux; Bernard Logel, Gundershoffen; Robert Strasser, Drachenbronn; Claude Valentin, Reichshoffen, all of France

[73] Assignee: Butagaz, Neuilly-sur-Seine, France

[21] Appl. No.: 852,243

[22] PCT Filed: Sep. 26, 1919

[86] PCT No.: PCT/FR91/00753

§ 371 Date: Jun. 1, 1992

§ 102(e) Date: Jun. 1, 1992

[87] PCT Pub. No.: WO92/06335

PCT Pub. Date: Apr. 16, 1992

[30] Foreign Application Priority Data

Oct. 1, 1990 [FR] France ..... 9012060

[51] Int. Cl.[5] ..... F24C 15/10; F24C 15/36

[52] U.S. Cl. ..... 219/444; 126/211; 126/220; 126/37 A

[58] Field of Search ..... 219/444, 450, 218; 126/37 R, 37 B, 37 A, 211, 220, 221; 312/236

[56] References Cited

U.S. PATENT DOCUMENTS

| | | | |
|---|---|---|---|
| 7,099 | 2/1850 | Clinton et al., | 126/220 |
| 874,295 | 12/1907 | Brand | 126/217 |
| 882,040 | 3/1908 | Windsor | 219/218 |
| 2,045,061 | 6/1936 | Ahrends et al. | 126/37 A |
| 2,105,596 | 1/1938 | Hoff | 126/37 R |
| 2,439,133 | 4/1948 | Jenkins | 219/218 |
| 2,548,032 | 4/1951 | Ball | 219/218 |
| 2,761,054 | 8/1956 | Locher | 126/37 B |
| 3,592,180 | 7/1971 | Kweller . | |
| 3,597,135 | 8/1971 | Kweller . | |
| 4,349,713 | 9/1982 | Marsen | 219/218 |

FOREIGN PATENT DOCUMENTS

| | | | |
|---|---|---|---|
| 205204 | 2/1959 | Australia | 126/211 |
| 84393 | 7/1909 | Fed. Rep. of Germany | 126/211 |
| 545522 | 2/1932 | Fed. Rep. of Germany | 126/220 |
| 469842 | 8/1914 | France | 126/211 |
| 961869 | 5/1950 | France | 126/37 R |
| 2253406 | 6/1975 | France | 126/37 A |
| 3-194321 | 8/1991 | Japan | 219/444 |
| 1382514 | 2/1975 | United Kingdom | 219/444 |
| 2185562 | 7/1987 | United Kingdom . | |
| 9008921 | 8/1990 | World Int. Prop. O. . | |

*Primary Examiner*—Bruce A. Reynolds
*Assistant Examiner*—John A. Jeffery
*Attorney, Agent, or Firm*—Jacobson, Price, Holman & Stern

[57] ABSTRACT

A cooking assembly for a cooker or a cooking top and comprises a cooking plate (1) and at least one heat generator (200) enabling a receptacle to be heated without coming directly into contact therewith. The cooking plate (1) includes an opening (4) associated with each heat generator (200) and enabling said generator to act directly, together with retractable closure means such as a moving plug (203) associated with each opening (4) to close said opening when the heat generator (200) is not in use, the moving plug (203) then being flush with the top surface (2) of the cooking plate (1), motorized means being provided for retracting said moving plug in order to unmask the heat generator so that it can be put into use. The invention is applicable to cooking assemblies for gas cookers and/or electric cookers having a cooking plate made of molded glass, of vitroceramic, or of agglomerated inorganic fibers.

27 Claims, 4 Drawing Sheets

COOKING TOP COVER WITH MOTORIZED RETRACTABLE CLOSURE MEANS ASSEMBLY

The present invention relates to a cooking assembly for a cooker or for a cooking top, this assembly being of the type comprising a cooking plate and at least one integrated heat generator enabling a receptacle to be heated without coming directly into contact therewith.

Cooking assemblies have been known for a long time that make use of gas burners, natural gas or LPG, as have the advantages they provide (flexibility, low inertia, adjustments immediately visible), however their drawbacks are also known (presence of a grid in the form of a frame which needs to be cleaned frequently and whose appearance appears to be more and more out-of-date, even as used with a sheet of molded glass on which gas burners are placed, as has been done recently, and as illustrated in U.S. Pat. Nos. 3,592,180 and 3,597,135 for example).

Cooking assemblies have also been known for a long time that use plates with electrical resistances, that do not use any frame-like grid since the receptacles to be heated are placed directly on the hotplates, however their drawbacks are also known (high inertia, adjustments difficult to visualize).

An important change has occurred with the appearance of vitroceramic plates having halogen lamps, since such plates benefit from two considerable advantages, namely ease of cleaning (the surface of the cooking plate is plane over its entire area) and an external appearance that is clearly new, giving a more modern look.

However, such systems still suffer from limited flexibility, and they require sophisticated design to ensure safety. In addition, it remains necessary to ensure that the vitroceramic plate does not rise to a temperature that is too high, thereby requiring safety devices to be present (temperature sensors and temperature limiters) with the drawback of limiting heating power.

Attempts have also been made to renovate gas cookers by using a vitroceramic cooking plate, as illustrated for example in Documents FR-A-2 282 604 and FR-A-2 351 359.

However, the presence of gas burners disposed beneath the plane vitroceramic plate further increases thermal inertia and causes efficiency to be considerably reduced. Under such circumstances, the heat transmitted comes almost solely from radiation: the combustion gases are trapped beneath the vitroceramic plate and must be removed via slots provided at the back of said plate, such that practically no heat is transmitted by convection. The option of transmitting heat by convection is thus almost totally lost, which heat potentially constitutes about two-thirds of the heat energy produced by a gas burner. In addition, it is even more necessary under such circumstances to ensure that the vitroceramic plate is not overheated, thus requiring temperature limiters to be provided between the gas burners and the said plate (it is essential to keep temperature to below about 540° C., thereby also putting a limit on the types of burner that can be used, and in particular preventing direct contact with a naked flame). The confinement of the combustion gases also constitutes a difficulty that is very difficult to overcome, and in any event puts a limit on utilization options: finally, this technique which tends towards an electrical installation does not give rise to performance that is equivalent to that obtained from halogen lamps or induction.

An object of the invention is to design a cooking assembly whose design makes it possible to obtain the main advantages of more recent electrical systems that have a cooking plate, while avoiding the drawbacks of the prior art with respect to inertia and safety.

Another object of the invention is to make it possible, if so desired, to use gas burners, with the advantages specific to gas, and without putting limits on the type of burner used.

Another object of the invention is to design a cooking assembly making it possible to use a vitroceramic cooking plate without running the risk of said plate becoming too hot, and without confining the atmosphere beneath it.

More particularly, the present invention provides a cooking assembly for a cooker or a cooking top, the assembly comprising a cooking plate and at least one heat generator enabling a receptacle to be heated without coming directly into contact therewith, the assembly being characterized by the fact that the cooking plate includes an opening associated with each heat generator and enabling said generator to act directly via said opening when the corresponding heat generator is in use, said heat generator being integrated in a well disposed beneath the cooking plate coaxially with the associated opening, and by the fact that retractable closure means are associated with the opening, said retractable closure means including a moving plug closing the associated opening when said heat generator is not in use, said plug being displaceable by means of motorized displacement means between a closure position in which the heat generator is masked, with the plug then being flush with the top surface of said cooking plate, and a retracted position in which said heat generator is unmasked for use. Advantageously, the cooking plate and the moving plug(s) are made of molded glass or of vitroceramic, or of a solid material constituted by inorganic substances coated with an organic polymer binder.

Preferably, the moving plug is in the form of a circular or oval cap whose top face is flush with the top surface of the cooking plate when said plug is in its closure position.

It is also advantageous for the moving plug to have an outside edge which is chamfered, preferably conically, and which co-operates with the corresponding inside edge of the associated opening when said plug is in its closure position; in particular, the side edge of the moving plug may have a cylindrical top portion with a sealing ring that withstands high temperature fitted thereover.

It is particularly advantageous for the motorized displacement means to displace the moving plug vertically when it is in line with the associated opening, and to displace said moving plug horizontally beneath the cooking plate when the plug is disengaged from the associated opening.

In a first variant, the motorized displacement means are common to a plurality of moving plugs and comprise a common support assembly to which said moving plugs are secured, said common support assembly being rotatable in a horizontal plane about a vertical axis, and being movable in translation along said vertical axis.

In which case, it is advantageous for the motorized displacement means to include an electromagnet providing vertical translation of said common support assembly, and a motor causing said common support assembly to rotate in a horizontal plane by means of an associated transmission such as a gear transmission or a belt. It is also possible for the common support assembly to be fitted with a clutch system enabling only one moving plug in the corresponding group of plugs to be moved.

In another variant, the motorized displacement means are individually associated with each moving plug and comprise an individual support assembly on which the associated moving plug is mounted, said individual support assembly being movable in translation along a vertical axis, and being movable in translation or in rotation in a horizontal plane.

In one possible embodiment, each moving plug is mounted on a hinged arm associated with a sliding carriage actuated by an associated motor such that said moving plug is displaceable in vertical translation by said arm tilting, and is displaceable in horizontal translation by said carriage sliding; in particular, the hinged arm is tilted by a fixed abutment for raising the moving plug, and by a return spring connected to the sliding carriage for lowering said moving plug.

In another possible embodiment, each moving plug is mounted on a swinging horizontal arm mounted via a nut on a vertical threaded rod which is disposed eccentrically relative to the associated opening and which is rotated by an associated motor, the screw and nut system constituted in this way being capable of rotating said swinging horizontal arm by friction so as to cause the arm to swing when said moving plug is disengaged from the associated opening.

It is also advantageous for the well in which the heat generator to be integrated coaxially to support a vertically moving chimney while nevertheless remaining beneath the cooking plate, said chimney being displaceable between a low position in which it allows the moving plug to pass during horizontal displacement thereof, and a high position in which it closes the space surrounding said heat generator.

It is also advantageous for the well in which the heat generator is integrated coaxially to support a retractable support grid capable of passing through the associated opening, said grid being vertically displaceable between a low position in which it allows the moving plug to pass during horizontal displacement thereof, and a high position in which it stands proud of the top surface of the cooking plate so as to serve as a support for a receptacle to be heated.

It is then preferable for the moving chimney and/or the retractable support grid to be connected to the well by a system of inclined ramps enabling them to be displaced vertically by rotating relative to said well. In particular, the retractable support grid rests freely on the moving chimney, and the moving chimney rests freely on the well which may be stationary, vertical displacement of the moving equipment constituted by said grid and said chimney being provided by a motor causing said chimney to rotate about the axis of said stationary well.

Also advantageously, the well in which the heat generator is integrated has an annular channel in the vicinity of its periphery and constituting a retention volume for liquid that has boiled over. It is then preferable for the moving chimney to have an inner support flange on which the retractable support grid is placed, said flange terminating by a converging free bottom edge for directing liquid that has boiled over into said annular channel.

In addition, it is advantageous for the heat generator to be fixed in the associated well in separable manner so as to facilitate access to said well for cleaning purposes; in particular, the heat generator is screwed or clipped to the bottom of the well, level with an inner flange of said well which delimits a feed chamber for the air-gas mixture.

In which case, the heat generator is a burner for natural gas or for LPG; in particular, the heat generator is a radiant burner or is a porous or fiber burner made of ceramic or of metal, each burner preferably being fed with air by an associated fan, said air causing the required amount of gas for making up the mixture to be induced via a venturi, with the gas being injected into the throat thereof.

In a variant, the heat generator is an electrical generator of the Joule effect type or of the halogen lamp type.

Other characteristics and advantages of the invention appear more clearly in the light of the following description of particular embodiments and given with reference to the accompanying drawings, in which:

FIGS. 1 and 2 are two diagrammatic sections showing a portion of a cooking assembly of the invention in which an opening formed through a cooking plate can be closed by a retractable moving plug, and in which the heat generator is integrated in a stationary well, FIG. 1 thus showing the plug in its retracted position and FIG. 2 showing it in its closure position;

FIGS. 3*a* and 3*b* show particular examples of plugs in the form of caps having a chamfered edge, and in FIG. 3*b* also including a sealing ring;

Figure 10A:
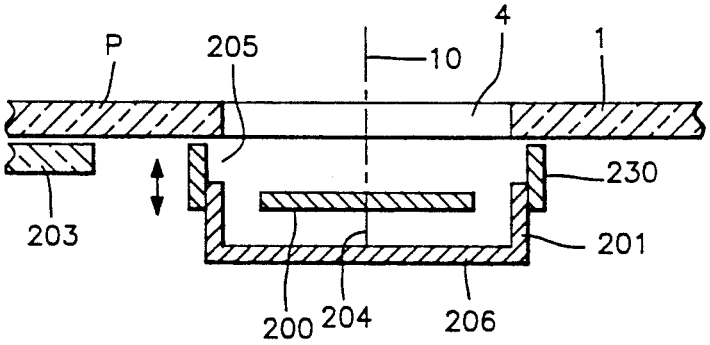
Figure 10B:
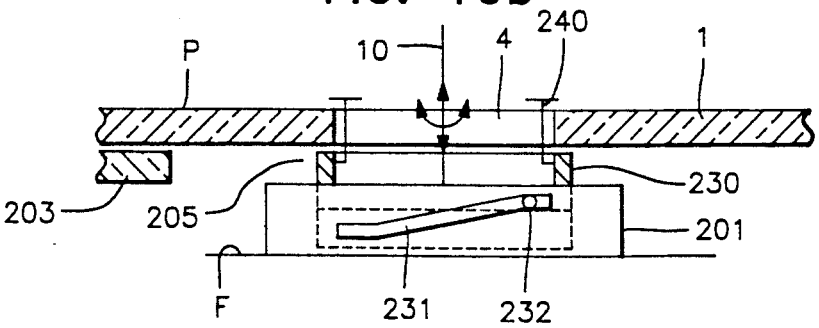
Figure 11:
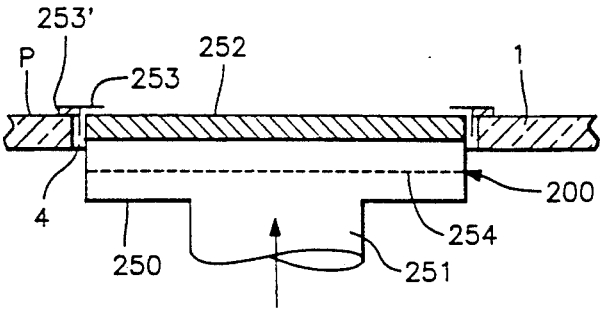
Figure 12:
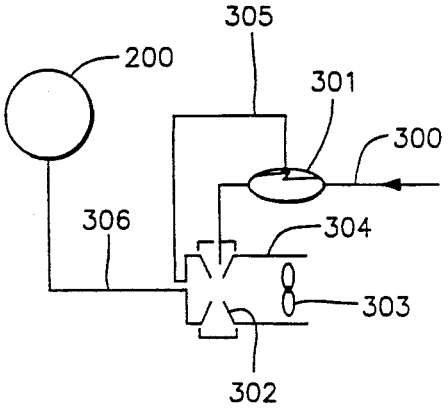
Figure 13:
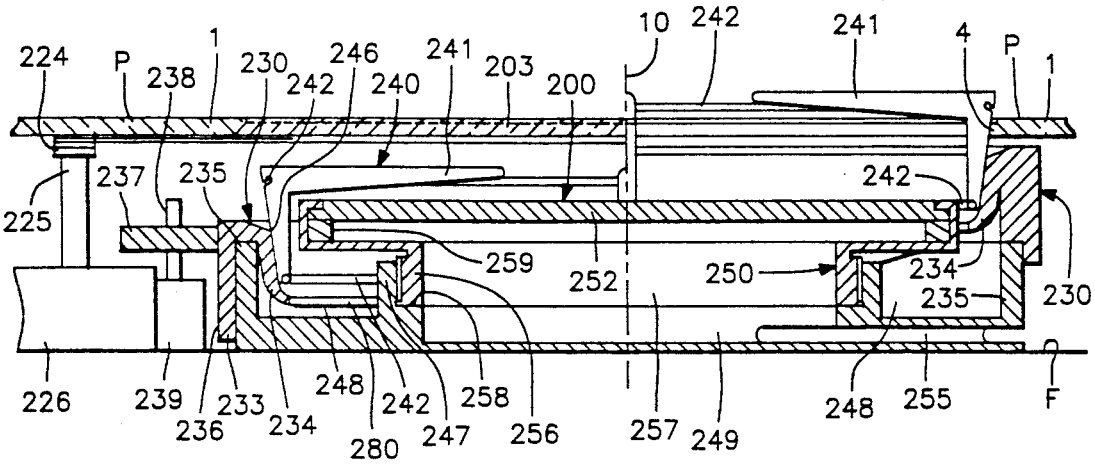
Figure 14:
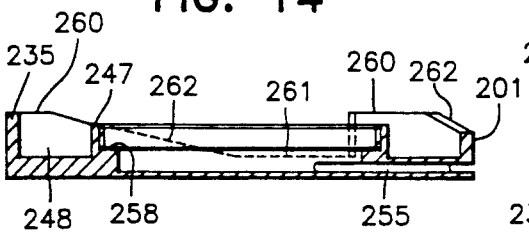
Figure 16:
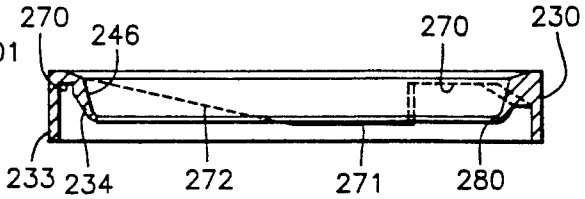
Figure 18:
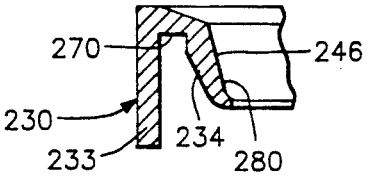
Figure 15:
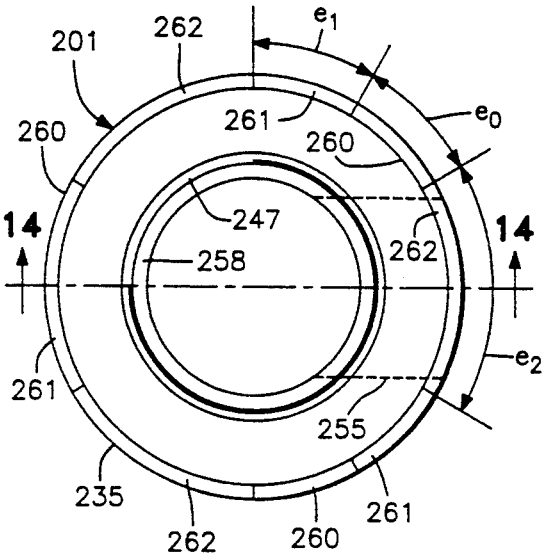
Figure 17:
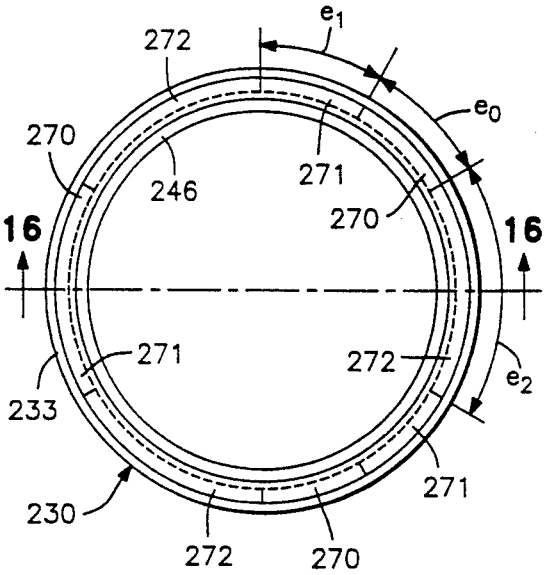
Figure 19:
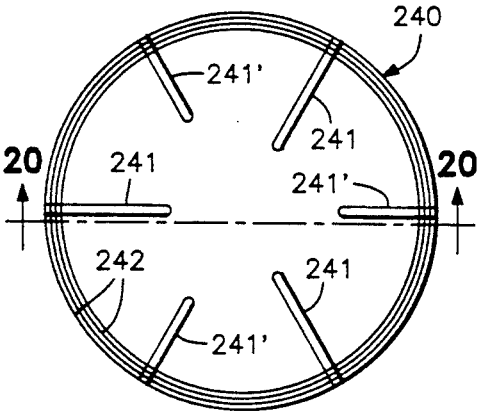
Figure 22:
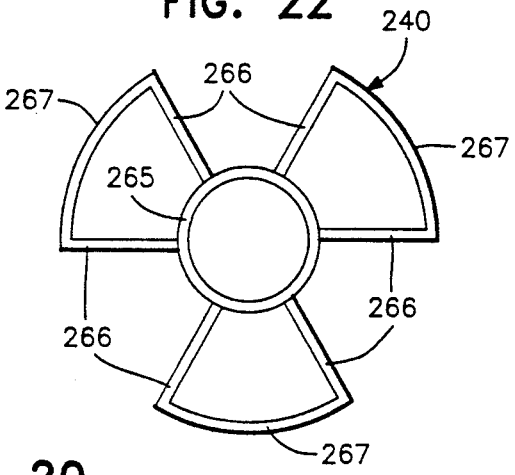
Figure 20:
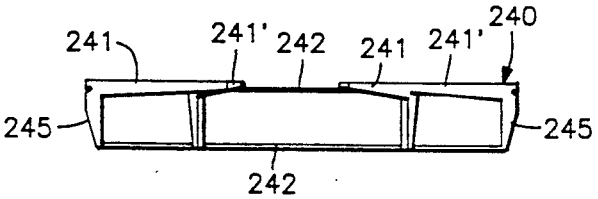
Figure 21:
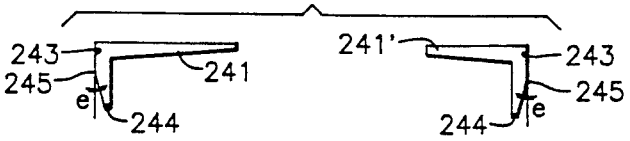

FIG. 10*a* shows a variant having a sliding closure chimney (shown in the high position in this figure) supported by a well in which the heat generator is integrated (the moving plug and the associated motorized displacement means are not shown);

FIG. 10*b* shows another variant having a retractable support grid (shown in its high position), which is moved by a system of sloping ramps;

FIG. 11 shows a special heat generator which can be integrated in a stationary well, said generator being constituted in this case by a metal-fiber radiant burner;

FIG. 12 is a diagram showing a preferred way of feeding the above radiant burner, including an air feed by means of a fan;

FIG. 13 is a full section view through an embodiment of a heat generator (of the type shown in FIG. 11) integrated in a stationary well and associated with a moving plug, together with a sliding chimney and a support grid placed freely on said chimney, the lefthand half-section corresponding to a closure position of the plug, and the righthand half-section corresponding to a retracted position of the plug, with the support grid then standing proud of the top surface of the cooking plate;

FIGS. 14 and 15 are respectively a section view and a plan view (FIG. 14 being a section on XIV—XIV of FIG. 15) showing the well of the cooking assembly of FIG. 13;

FIGS. 16 and 17 are respectively a section view and a plan view (with FIG. 16 being a section on XVI—XVI of FIG. 17) showing the sliding chimney of said assembly, with the support flange of the grid being more clearly visible in FIG. 18 which is a larger-scale section of a detail;

FIG. 19 is a plan view of the support grid of said assembly, with the structure thereof being shown in greater detail in the associated section of FIG. 20 which is a section on XX—XX of FIG. 19, and by the view of FIG. 21 which shows two radial segments of said support grid; and FIG. 22 is a plan view of another possible form of the support grid comprising sector-shaped members, with the curved bar constituting the outline thereof being of any section, in particular being of circular or polygonal section.

The cooking assembly for a cooker or a cooking top that is described below is of the type comprising a cooking plate and at least one heat generator enabling a receptacle to be heated without coming directly into contact therewith.

In accordance with an essential aspect of the invention, the cooking assembly comprises a cooking plate having an opening associated with each heat generator and enabling said generator to act directly through said opening when the corresponding heat generator is in use, together with retractable closure means comprising a moving plug in associated with each opening, serving to close said opening when the corresponding heat generator is not in use, then coming flush with the top surface of said cooking plate and unmasking said opening when said heat generator is to be used.

Figure 1:
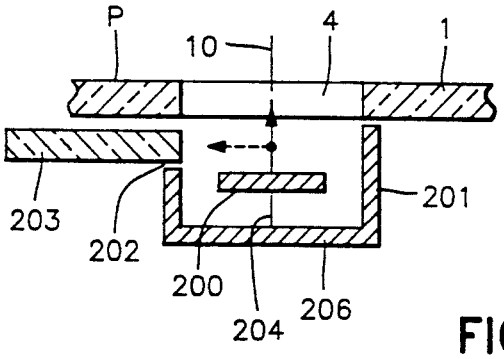
Figure 2:
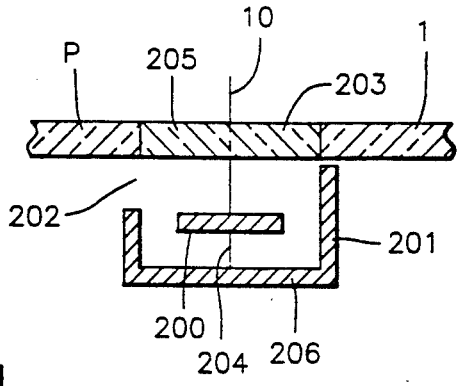

Such an arrangement is shown in FIGS. 1 and 2 in which there can be seen a cooking plate 1 including an opening 4 associated with a heat generator 200 which is integrated in a stationary well 201, e.g. by being fixed by means of a support 204 connected to the bottom 206 of the well 201. The closure means comprise a moving plug 203 which closes the associated opening 4 when the heat generator 200 is not in use: the moving plug is displaceable by motorized displacement means that are described below to move between a closure position (FIG. 2) in which the heat generator is masked, and a retracted position (FIG. 1) in which the said heat generator is unmasked for use. The well 201 must allow the moving plug 203 to pass therethrough, and to this end it includes a lateral opening 202 occupying part or all of the periphery of the well 201. The dashed line arrows in FIG. 1 show how the moving plug 203 must be capable of being displaced firstly in vertical translation parallel to the axis 10 of the associated opening 4, in order to disengage the plug and open the opening 4, or conversely to close said opening to mask the heat generator 200, and secondly in lateral translation essentially in a horizontal plane once the moving plug is in its low position, thereby completely unmasking the burner 200, or conversely thereby bringing the plug into line with its position for closing the opening 4.

As can be seen in FIG. 2, when the moving plug 203 is in its closure position, the top face 205 of the plug is flush with the top surface P of the cooking plate 1: as a result the moving plug(s) 203 finish off the surface of the cooking plate 1 perfectly so that its external appearance is that of a single continuous surface. In addition, as can clearly be seen in FIG. 1, the cooking plate 1 may serve directly as a support for a receptacle to be heated, in which case it is nevertheless necessary to provide an opening 4 whose size is compatible with the smallest receptacle, and also to provide evacuation for combustion gases. Such a solution is elegant insofar as it makes it possible to avoid having any kind of support grid for a receptacle to be heated; however, for more powerful burners, it runs the risk of raising a problem of power per unit area. For example, if a 3 kW burner is associated with a diameter of 8 cm, then the heat it produces is in danger of being too concentrated in the middle of the receptacle, and cooking conditions will not be ideal. As a result, it is advantageous to provide a retractable support grid, as described below with reference to FIGS. 10*b* and 13.

The plug(s) 203 may take up various different shapes, but for obvious reasons of efficiency it is necessary to promote contact between combustion products and receptacles, so in practice a circular shape or an oval shape is required. A more elongate and substantially oval shape may be advantageous for special applications (fish dishes, griles, etc. . . . ). These plugs are advantageously made using the same material as that which the cooking plate is made, i.e. molded glass or vitroceramic, for example, or else they are made of a solid material constituted by inorganic substances coated with an organic polymer binder, providing, naturally, that said material is mechanically strong enough and can withstand the temperatures involved.

Figure 3A:
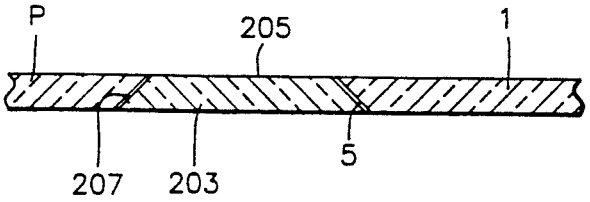
Figure 3B:
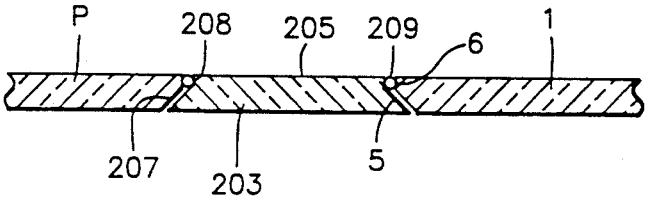

FIGS. 3*a* and 3*b* show two particular examples of caps having chamfered edges, with FIG. 3*b* showing an assembly with a sealing ring. It is advantageous to provide good watertightness when the moving plug is in its closure position. As can be seen in FIG. 3*a*, the moving plug 203 has a chamfered outside edge 207 which is preferably conical in shape, and which co-operates with a corresponding inside edge 5 of the associated opening 4 in the cooking plate 1 when said plug is in its closure position. Such a solution is particularly advantageous with a cooking plate made of vitroceramic or of molded glass or of agglomerated inorganic substances, in which case it is advantageous further to provide for said cooperating faces to be ground so that they come into more intimate contact. In a variant, as shown in FIG. 3*b*, the side edge of the moving plug 203 has a top portion 208 that is cylindrical and on which a sealing ring 209 is disposed, which sealing ring is made of material such as an elastomer that withstands high temperatures. The corresponding inside edge of the opening 4 in the cooking plate 1 then terminates with a cylindrical portion 6 running on from its conical edge 5 so as to provide just enough compression of the sealing ring 209 when the plug 203 is in its closure position.

In general, it is advantageous to provide for the cooking plate 1 and the plug(s) 203 to be made of the same material, in particular a vitroceramic, a molded glass, or agglomerated inorganic substances, as mentioned above.

Various types of motorized displacement means are described below. They are associated with each moving plug and they are suitable for enabling said plug to be displaced easily between its closure position and its retracted position. The motorized displacement means must be capable of causing the moving plug 203 to be displaced vertically when it is in line with the associated opening 4, and for the plug to be displaced essentially horizontally beneath the cooking plate 1 once the plug has been disengaged from said associated opening. Naturally, various different solutions are possible for providing such displacements of the moving plug 203, and FIGS. 4 to 9 illustrate three types of motorized displacement means by way of example.

Figure 4:
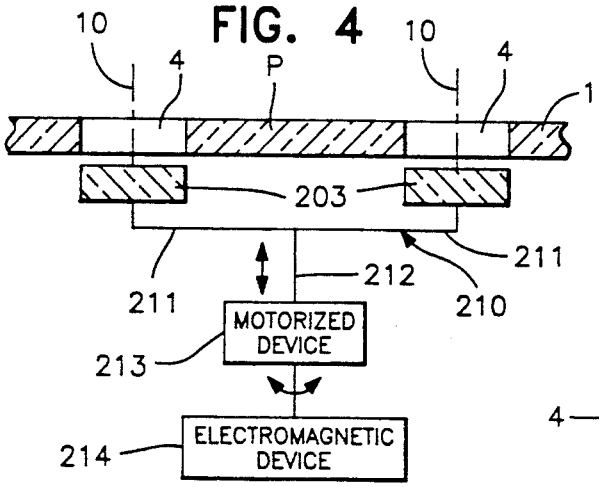
FIG. 4 is a diagram of motorized displacement means associated with a plurality of moving plugs.
Figure 5:
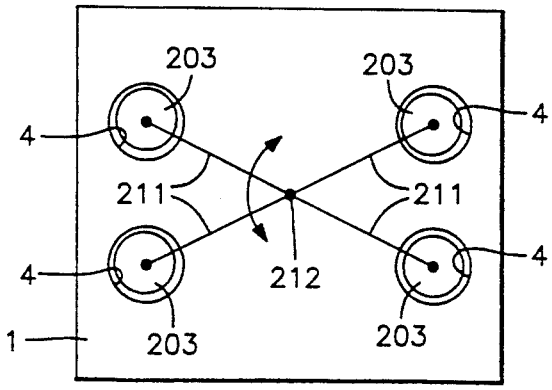
FIG. 5 is a view from beneath showing the common support assembly which is associated in this case with four moving plugs.

In the embodiment shown in FIGS. 4 and 5, the motorized displacement means are common to a plurality of moving plugs 203 (in this case they are common to four moving plugs), and comprise a common support assembly 210 to which the moving plugs 203 are secured, said common support assembly being movable in rotation in a horizontal plane about a vertical axis, and movable in translation along said vertical axis. The common support assembly 210 thus has a branch 211 associated with each of the plugs in question 203, said branches meeting at a vertical portion 212 which constitutes the above-mentioned vertical axis of the common support assembly. An electromagnetic device 213 serves to provide vertical translation, while a motorized device 214 serves to rotate the support assembly 210. The device may be a motor that serves to rotate said support assembly in a horizontal plane via an associated transmission, such as a gear transmission or a belt transmission. Under such circumstances, all of the moving plugs 203 are disengaged simultaneously. This solution has the advantage of simplicity, but it does not provide good protection for the cooking assembly in the event of a liquid boiling over at a burner in operation and reaching one of the burners that is not in operation, thereby wetting or dirtying said burners. To mitigate this drawback, it may be advantageous to fit the common support assembly 210 with a clutch system enabling only one of the moving plugs 203 in the corresponding group of plugs to be moved. The cooking assembly should naturally be provided with electronic control and synchronizing means suitable for causing one or more of the moving plugs 203 to move through a predetermined sequence when one or more of the heat generators 200 is to be put into operation, and for ensuring that a generator can be lighted only after the corresponding moving plug has been fully retracted.

Figure 6:
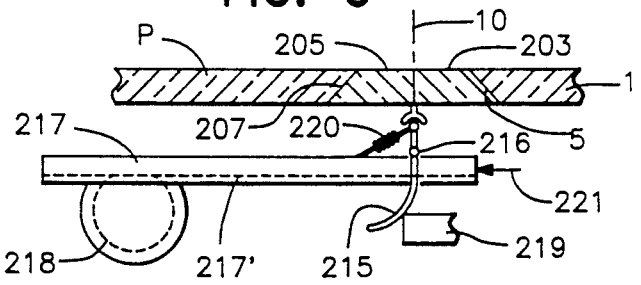
FIGS. 6 and 7 are section views respectively in the closure position and the retracted position showing a moving plug with its individual support assembly having a hinged arm and a sliding carriage enabling said plug to perform vertical translation and horizontal translation.
Figure 7:
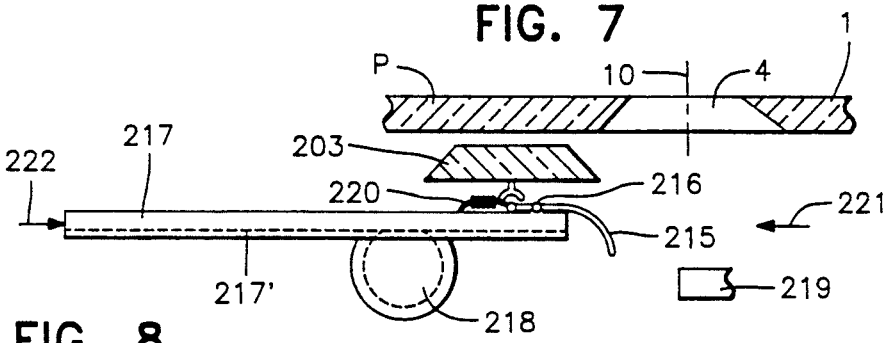
Figure 8:
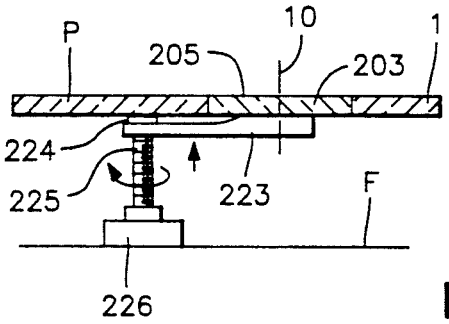
FIGS. 8 and 9 are views respectively in the closure position and in the retracted position showing a moving plug with a variant individual support assembly constituted by a swinging horizontal arm and by a screw and nut system.
Figure 9:
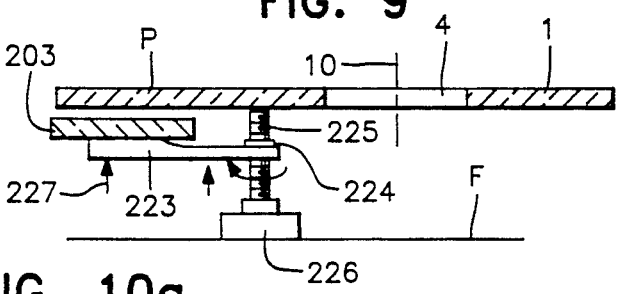

The embodiments shown in FIGS. 6 and 7 or in FIGS. 8 and 9 concern motorized displacement means that are individually associated with each moving plug 203. The means then include an individual support assembly on which the associated moving plug is mounted, said individual support assembly being movable in translation along a vertical axis and being movable in translation or in rotation in a horizontal plane.

In the variant shown in FIGS. 6 and 7, each moving plug 203 is mounted on a hinged arm 215 disposed on a sliding carriage 217 actuated by an associated motor so that the moving plug 203 is displaceable in vertical translation by tilting the hinged arm 215, and is displaceable in horizontal translation by displacing the carriage 217. The arm 215 is hinged via a pivot 216 to the carriage 217, and a return spring 220 urges the hinged arm 215 towards a tilted position corresponding to the moving plug 203 being in its low position (FIG. 7). The carriage 217 moves on a ramp that is horizontal or sloping, and that includes a lateral rack 217' that meshes with a pinion 218 secured to the outlet shaft of a control motor (not shown herein). It should be observed at this point that a cam 219 is associated with the hinged arm 215 and that two end-of-stroke abutments 221 and 222 (represented herein by arrows) are associated with the sliding carriage 217. When the moving plug 203 is in its closure position (FIG. 6), the hinged arm 215 is in contact with the associated cam 219 and is therefore held in an essentially vertical position against the action of the return spring 220, while the carriage 217 is engaged against its end-of-stroke abutment 221. If it is desired that the moving plug should take up its retracted position, then the motor causes the sliding carriage 217 to reverse, thereby automatically causing the hinged arm 215 to tilt, thereby retracting the moving plug 203 due to the action of the return spring 220, thus allowing the sliding carriage to reverse until it engages its end-of-stroke abutment 222, thereby guaranteeing that the moving plug 203 is fully retracted, as shown in FIG. 7. The end-of-stroke abutment 222 may serve as a reference contact for electronic control of the heat generator 200, and both abutments 221 and 222 preferably also serve as contacts for switching off power supply to the motor associated with driving the sliding carriage 217.

In the embodiment shown in FIGS. 8 and 9, each moving plug 203 is placed on a swinging horizontal arm 223 mounted via a nut 224 on a vertical threaded rod 225 which is disposed eccentrically relative to the associated opening 204, and with rotation thereof being provided by an associated motor 226 placed on the bottom F of the cooking assembly. The screw and nut system made up in this way must be capable of driving the swinging horizontal arm 223 by friction so as to cause it to swing after the moving plug 203 has just been or is disengaged from the associated opening 4.

Starting from the closure position of the moving plug 203 (FIG. 8), its position is changed by activating the motor 226 which causes the threaded rod 225 to rotate, thereby initially lowering the horizontal arm 223 until the moving plug 203 is completely disengaged from the associated opening 4 in the cooking plate 1. The friction drive obtained by the nut and screw system then continues to lower the horizontal arm 223 while simultaneously causing said arm to swing until the retracted position is reached (FIG. 9). An axial end-of-stroke abutment system 227 (represented in this case by an arrow) is then provided to stop the drive motor 226. To return to the closure position, the motor 226 is switched on to rotate in the opposite direction, thereby returning the plug 203 to a position where it is in line with the associated opening 4, as determined by an end-of-stroke abutment (not shown), after which the plug is moved into said opening and the motor 226 is then stopped by an axial end-of-stroke abutment, e.g. associated with the nut 224 coming into contact with the bottom face of the cooking plate 1.

In the embodiment shown in FIGS. 8 and 9, the threaded rod serves to provide both vertical displacement and rotation of the associated plug. In a variant that is not shown herein, it is also possible for vertical displacement to be provided by a system including a cam and a sloping ramp, while rotation is provided by a vertical rod analogous to the above-described threaded rod.

FIG. 10*a* shows a variant in which the stationary well 201 in which the heat generator 200 is integrated supports a coaxial chimney 230 that is vertically movable while remaining below the cooking plate 1, said chimney being displaceable between a low position in which it allows the moving plug 203 to move horizontally and a high position in which it encloses the space around said heat generator. Thus, when the moving chimney 230 is in its high position it serves to close the opening 205 associated with horizontal passage of the moving plug 203, thereby preventing liquid reaching said opening and then penetrating into the bottom region housing the drive mechanism in the event of a large amount of liquid boiling over. The displacement of the moving chimney 230 may be controlled by any appropriate means, and a sloping ramp system (not shown) associated with the supporting stationary well 201 is preferred.

FIG. 10*b* shows another variant in which the well 201 having the heat generator 200 integrated therein coaxially supports a retractable support grid 240 capable of passing through the associated opening 4. The support grid 240 is vertically displaceable between a low position in which it allows the moving plug 203 to go past while it is moving horizontally, and a high position in which it stands proud of the top surface P of the cooking plate 1, thereby serving to support a receptacle that is to be heated. This solution makes it easy to cope with a small-diameter receptacle to be heated, i.e. a receptacle whose diameter is less than the diameter of the associated opening 4 in the cooking plate 1, thereby making it possible to hold the receptacle above the heat generator 200. The retractable support grid 240 is also advantageous even when the receptacle to be heated is larger in diameter than the associated opening 4 insofar as it considerably facilitates evacuating combustion products, thereby making it possible to take full advantage of the energy supplied by convection. It should be observed that in the example of FIG. 10*b*, the retractable support grid 240 is mounted on the moving chimney 230 which is connected to the well 201 by a sloping ramp system enabling the assembly to move vertically by rotation relative to said well. There can be seen a projecting stud 232 carried by the moving chimney 230, which stud penetrates into a slot 230 that includes a sloping portion and which is provided in the side surface of the stationary well 201. By rotating the chimney 230 about its axis 10 using any suitable means, it is then easy to move both the closure chimney 230 and the support grid 240 from one position to the other.

The various different embodiments in which the heat generator is integrated in a stationary well 201 and in which the associated opening 4 can be closed by a moving plug 203 are compatible with a very wide range of types of heat generator. In practice, any type of heat generator is suitable providing it satisfies the necessary performance, hygiene, combustion, and size requirements. Mention may be made of "daisy" type burners (using natural gas or LPG), radiant ceramic burners (natural gas or LPG), combined radiant and blue flame burners (natural gas or LPG), ceramic fiber burners (natural gas or LPG), and metal fiber burners (natural gas or LPG). Naturally, it is also possible to use Joule effect electrical heat generators, or halogen lamps.

Nevertheless, and in general, metal fiber radiant burners constitute a solution that is particularly advantageous insofar as a major fraction of the energy (20% to 30%) is directly transmitted in the form of radiation, thereby considerably improving the cooking efficiency of such burners. In addition, the metal fiber material has very low thermal inertia because of the conductivity of the fibers and because of its high degree of porosity. The quantity of heat that accumulates therein is low and it is very easily recovered. To benefit fully from this advantage, it is nevertheless appropriate for the entire area in contact with the combustion products to have the same quality: an insulating coating that withstands high temperatures may then constitute an acceptable solution when the fiber material does not cover the entire area of the burner. It is also important to ensure that heat bridges do not arise so as to avoid unfavorable conduction between the combustion area and the combustion chamber: additional thermal protection may thus be provided in peripheral regions which are compressed for the purpose of fixing the burner, and possibly also for providing upstream protection on the portions of the burner that are not covered in fiber material. Such metal fiber burners can operate either in radiant mode (surface combustion raising the fibers on the surface to incandescence), or else in blue flame mode when the flow speed of the air-gas mixture through the porous medium becomes greater than the flame propagation speed of the same mixture. To obtain this mode of operation, it is possible either to increase the acceptable power per unit area of the burners, or else to reduce the propagation speed by changing the air/gas ratio. In radiant mode, such burners give off little NOx oxide (20 ppm to 40 ppm at stoichiometric combustion as compared with 200 ppm to 400 ppm in a conventional burner). It is then preferable to use metal fibers made using a material sold under the trademark FECRALLOY® having a diameter of 22 microns and a length of 4 mm, said fibers being randomly disposed parallel to the plane of the support and then compressed and sintered in order to provide a material whose porosity lies in the range 80% to 85%, with extremely little variation in porosity. The finished material is then in the form of a layer having a thickness in the range 1 mm to 4 mm, with a thickness of 2 mm providing a cost/performance comprise that gives full satisfaction.

Reference may also be made to Document EP A-0 157 432, incorporated herein by reference, where a porous metal fiber material is described which is particularly well adapted to making a gas burner of the above-specified type. Such a fiber material makes it possible to provide burners having a high degree of flexibility in adjustment (ratio between maximum power and minimum power greater than four).

FIG. 11 shows a radiant burner of this type in which the burner 200 comprises a burner body 250 supporting a thickness of fiber material 252 that closes the air-gas mixture chamber 251. The metal fiber layer 252 is fixed to the body 250 by any means, for example and as shown herein, by a crimping ring 253, which ring has a T-shaped section in this case with one half overlying the edge of the opening 4 through the cooking plate 1, via an interposed flat gasket 253', e.g. made of silicone that ensures the assembly has the desired degree of flexibility and is completely watertight relative to liquid boiling over. In a variant, it is possible to obtain compression by screwing on a cover, by gluing using a ceramic glue, by riveting, by stapling, or by screwing. It may also be advantageous to provide a distributing and homogenizing device, represented herein as a mesh 254, thereby enabling the entire rear face of the fiber material 252 to be fed uniformly, and thus avoiding the formation of preferred paths.

FIG. 12 is a diagram showing an advantageous way of feeding a radiant burner of the above-specified type. There can thus be seen a gas feed duct 300 fitted with an expander 301 which opens out into a venturi 302: air is brought in via a duct 304 under drive from a fan 303. Thus, each radiant burner 200 is fed with air by means of an associated fan 303, and the air (delivered via the associated venturi 302) draws in gas at the throat of the venturi to produce the appropriate mixture. Gas pressure is adjusted by the associated expander 301 which is preferably controlled via a feedback loop 305 as a function of the pressure of the air-gas mixture that is finally delivered by the duct 306 to the radiant burner 200. The fan 303 may be controlled by an associated electrical dimmer-type circuit, thereby varying the air flow rate and thus the power of the burner: this makes it possible to eliminate electrical or electromechanical actuators and to fit the cooking assembly with touch-sensitive controls.

FIGS. 13 to 21 described below show a complete embodiment of a heat generator integrated in a stationary well including a moving plug and a sliding chimney together with a support grid freely supported by said chimney.

FIG. 13 shows several members that are described above, including the motorized displacement means associated with the moving plug 203, which are implemented in this case by the variant shown in FIGS. 8 and 9. These means are given the same references and they are therefore not described again.

With reference to FIG. 13 and also to FIGS. 14 and 15, it can be seen that the well 201 includes an annular channel 248 in the vicinity of its periphery, which channel constitutes a retention volume for boiled-over liquid. The annular channel 248 is defined by an outer ring 235 and by an inner ring 247, the outer ring 235 serving directly to support the sliding chimney 230, and the inner ring 247 serving to hold the heat generator 200. The bottom of the well 201 has an opening 255 for admitting the air-gas mixture, said opening extending radially towards the axis 10 opening out into a central chamber 249 which communicates with the inside chamber 257 of the heat generator 200. The heat generator 200 is held by its base flange 256 which presses against a shoulder 258 of the well 201, inside the inner ring 247 of said well.

The heat generator 200 is preferably fixed in separable manner inside the associated well 201 in order to facilitate access to said well for cleaning purposes. For example, the heat generator 200 may be screwed or clipped to the base of the well, at the inside ring 247 of said well which delimits the feed chamber for the air-gas mixture. The top portion of the heat generator 200 which is of the type having a metal fiber structure radiant burner, includes a metal fiber layer 252 which is held in place in this case by crimping by folding over a top flange of the body 250 which locally compresses the periphery of the fiber layer 252, which layer is supported by a rigid ring 259 that forms a spacer received in the body of the burner 250 and preferably made of metal.

With reference to FIGS. 14 and 15, it can be seen that the outer ring 235 has a top edge which includes a system of sloping ramps: there can thus be seen in succession angularly distributed thereabout: high horizontal portions 260; sloping ramp portions 262; and low horizontal portions 261. The angular distribution of the various portions is defined by angles $e_0$, $e_1$, and $e_2$ which are respectively associated with the portions 260, 261, and 262. It is preferable for the angles $e_0$ and $e_1$ to be equal to 30° while the angle $e_2$ is equal to 60°. The shape of the top edge of said outer ring is naturally matched to the corresponding shape of the chimney which it supports, as explained below with reference to FIGS. 16 to 18.

The chimney 230 has an outer ring 233 and an inner ring 234, the outer ring having an area 236 suitable for being driven by a wheel or a gear wheel 237 mounted on the outlet shaft 238 of a drive motor 239 (FIG. 13). The inner ring 234 of the chimney 230 has a sloping edge 246 (FIG. 16) suitable for supporting the grid 240, which grid stands freely on the moving chimney 230. Thus, as is more clearly visible in FIG. 18, the inside surface or support flange 246 on which the retractable support grid 240 is placed is terminated by a converging free bottom edge 280 for directing liquid that has boiled over into the annular channel 248 of the well 201. In addition, between its rings 233 and 246, the chimney 230 has a support edge associated with the fixed well and having high horizontal portions 270, low horizontal portions 271, and sloping portions 272, said portions naturally corresponding to the corresponding portions provided on the well 201. As a result, they are angularly distributed around angles $e_0$, $e_1$, and $e_2$ in the same way. Thus, actuating the motor 239 causes the chimney 230 to rotate about the axis 10 in one direction or the other, thereby raising or lowering said chimney and consequently raising or lowering the retractable grid that is supports.

With reference to FIGS. 19 to 21, it can be seen that the retractable support grid 240 is constituted in this case in the form of two coaxial rings 242, e.g. made of round section metal wire having a diameter of about 2 mm, which rings are supported by radial segments 241, 241', said segments having associated notches 243 and 244 for receiving the said two rings. It should be observed that the radial segments 241 and 241' are of different lengths in this case and that they present an outside bottom facet 245 whose slope (angle e) is of the order of 12°, for example, which slope is naturally selected as a function of the shape of the support flange 246 provided on the chimney 230.

It will naturally be understood that numerous other shapes are also possible for making said retractable support grid: FIG. 22 shows another possible shape by way of example, where the grid 240 is in the form of sectors and is made by bending a section bar. The outline in this case comprises an inside circle 265 from which a plurality of sectors project (in this case three sectors) with each of the sectors being defined by two radial branches 266 and by a circular branch 267 interconnecting said radial branches. The curved bar constituting the outline may be of any section, in particular it may be circular or polygonal in section.

When a retractable support grid is used, it is possible to match the diameters of the openings 4 in the cooking plate 1 to the powers of the heat generators 200 used. This solution thus makes better heat distribution possible, and the respective powers of the heat generators are directly accessible to the user. This makes it possible in particular to increase the heating area so as to avoid hot points on the receptacles to be heated and so as to accurately match power to heating area.

It should be observed that the well 201 in which the heat generator 200 is integrated serves a plurality of functions simultaneously:

it serves to channel all of the combustion products so as to distribute them uniformly beneath the receptacle to be heated, while preventing them from spreading beneath the surface of the cooking plate 1;

it defines a retention volume for liquids that have boiled over (annular channel 248); and it serves to support moving equipment constituted by a sliding chimney and by a retractable support grid.

As mentioned above, it is also possible to use Joule effect or halogen lamp electrical generators integrated in a stationary well 201. With Joule effect electrical generators, it may be advantageous to provide a fan for blowing air over a heating resistance: under such circumstances, the power supplied to the resistance should be matched to the speed of the fan in order to modulate the power of the generator. Directly heating a receptacle by halogen lamps definitely improves efficiency, and it eliminates thermal inertia when the lamps are switched off. The halogen lamps are then preferably disposed at the periphery of the well so as to avoid thermal shocks due to splashes.

The air-gas mixture may be prepared by using a device in which air is sucked in by the gas, providing the burner integrated in the stationary well is fed with enough secondary air. It would also be possible to use blown air with a centralized air feed and with decentralized mixing of air and gas, as described above with reference to FIG. 12. Under such circumstances, a fan is used to power each of the burners individually, and each burner is fitted with its own expander so as to prevent changes in pressure as a function of the number of burners in operation. Air and gas may be delivered via two valves controlled in parallel so as to provide the desired mixture over the entire operating range: in a variant, the air draws in the amount of gas required to make the mixture by means of an associated venturi, in which case gas pressure is regulated by an expander controlled by the air pressure downstream from the venturi, and gas is injected into the throat of the venturi as described above with reference to FIG. 12.

The invention is not limited to the embodiments described above, but on the contrary it covers any variant that uses equivalent means to reproduce the essential characteristics specified in the claims.

We claim:

1. A cooking assembly for a cooker or a cooking top, the assembly comprising:

a cooking plate, at least one heat generator enabling a receptacle to be heated on said cooking plate without coming directly into contact with said at least one heat generator, the cooking plate including an opening associated with each heat generator and enabling said generator to act directly on a receptacle on said cooking plate via said opening when the corresponding heat generator is in use, said heat generator being integrated in a well disposed beneath the cooking plate coaxially with the associated opening, and retractable closure means associated with the opening, said retractable closure means including a moving plug for closing the associated opening when said heat generator is not in use, said plug being displaceable by motorized displacement means for moving said plug between a closure position in which the heat generator is masked, with the plug then being flush with a top surface of said cooking plate, and a retracted position in which said heat generator is unmasked for use, said motorized displacement means displacing the moving plug vertically when the plug is in line with the associated opening, and displacing said moving plug horizontally beneath the cooking plate when the plug is disengaged from the associated opening.

2. A cooking assembly according to claim 1, wherein the moving plug is in the form of one of a circular cap and oval cap whose top face is flush with the top surface of the cooking plate when said plug is in its closure position.

3. A cooking assembly according to claim 2, wherein the moving plug has an outside edge which is chamfered and which co-operates with a corresponding inside edge of the associated opening when said plug is in its closure position.

4. A cooking assembly according to claim 3, wherein a side edge of the moving plug has a cylindrical top portion with a sealing ring fitted thereover that withstands high temperature.

5. A cooking assembly according to claim 1, wherein the cooking plate and the plug are made of one of molded glass, vitroceramic, and a solid material constituted by inorganic substances coated with an organic polymer binder.

6. A cooking assembly according to claim 1, wherein the motorized displacement means are common to a plurality of moving plugs and comprise a common support assembly to which said moving plugs are secured, said common support assembly being rotatable in a horizontal plane about a vertical axis, and being movable in translation along said vertical axis.

7. A cooking assembly according to claim 6, wherein the motorized displacement means include an electromagnet providing vertical translation of said common support assembly, and a motor causing said common support assembly to rotate in a horizontal plane by an associated transmission.

8. A cooking assembly according to claim 7, wherein the common support assembly is fitted with a clutch system enabling only one moving plug in the corresponding group of plugs to be moved.

9. A cooking assembly according to claim 1, wherein the motorized displacement means are individually associated with each moving plug and comprise an individual support assembly on which the associated moving plug is mounted, said individual support assembly being movable in translation along a vertical axis, and being movable in one of in translation and in rotation in a horizontal plane.

10. A cooking assembly according to claim 9, wherein each moving plug is mounted on a hinged arm associated with a sliding carriage actuated by an associated motor such that said moving plug is displaceable in vertical translation by said arm tilting, and is displaceable in horizontal translation by said carriage sliding.

11. A cooking assembly according to claim 10, wherein the hinged arm is tilted by a fixed abutment for raising the moving plug, and by a return spring connected to the sliding carriage for lowering said moving plug.

12. A cooking assembly according to claim 9, wherein each moving plug is mounted on a swinging horizontal arm mounted via a nut on a vertical threaded rod which is disposed eccentrically relative to the associated opening and which is rotated by an associated motor, the nut and screw being capable of rotating said swinging horizontal arm by friction so as to cause the arm to swing when said moving plug is disengaged from the associated opening.

13. A cooking assembly according to claim 1, wherein the well in which the heat generator is integrated with coaxially supports a vertically moving chimney while remaining beneath the cooking plate, said chimney being displaceable between a low position in which said chimney allows the moving plug to pass during horizontal displacement thereof, and a high position in which said chimney closes the space surrounding said heat generator.

14. A cooking assembly according to claim 13, wherein the moving chimney is connected to the well by a system of inclined ramps enabling them to be displaced vertically by rotating relative to said well.

15. A cooking assembly according to claim 14, wherein a retractable support grid rests freely on the moving chimney, and the moving chimney rests freely on the well which is stationary, vertical displacement of the moving equipment constituted by said grid and said chimney being provided by a motor causing said chimney to rotate about the axis of said stationary well.

16. A cooking assembly according to claim 15, wherein the moving chimney has an inner support flange on which the retractable support grid is placed, said flange terminating by a converging free bottom edge for directing liquid that has boiled over into said annular channel.

17. A cooking assembly according to claim 1, wherein the well in which the heat generator is integrated with coaxially supports a retractable support grid capable of passing through the associated opening, said grid being vertically displaceable between a low position in which said grid allows the moving plug to pass during horizontal displacement thereof, and a high position in which said grid stands proud of the top surface of the cooking plate so as to serve as a support for a receptacle to be heated.

18. A cooking assembly according to claim 15, wherein the retractable support grid is connected to the well by a system of inclined ramps enabling them to be displaced vertically by rotating relative to said well.

19. A cooking assembly according to claim 1, wherein the well in which the heat generator is integrated has an annular channel in the vicinity of its periphery and constituting a retention volume for liquid that has boiled over.

20. A cooking assembly according to claim 1, wherein the heat generator is fixed int he associated well in separable manner so as to facilitate access to said well for cleaning purposes.

21. A cooking assembly according to claim 20, wherein the heat generator is screwed or clipped to the bottom of the well, level with an inner flange of said well which delimits a feed chamber for an air-gas mixture.

22. A cooking assembly according to claim 1, wherein the heat generator is a burner for gas.

23. A cooking assembly according to claim 22, wherein the heat generator is a radiant burner.

24. A cooking assembly according to claim 23, wherein each burner is fed with air by an associated fan, said air causing the required amount of gas for making up a mixture to be induced via a venturi with the gas being injected into a throat thereof.

25. A cooking assembly according to claim 22, wherein the heat generator is a porous burner.

26. A cooking assembly according to claim 22, wherein the heat generator is a fiber burner.

27. A cooking assembly according to claim 1, wherein the heat generator is one of an electrical generator of the Joule effect type and of the halogen lamp type.

* * * * *

UNITED STATES PATENT AND TRADEMARK OFFICE

CERTIFICATE OF CORRECTION

PATENT NO. : 5,313,049

DATED : May 17, 1994

INVENTOR(S) : Georges Le STRAT et al

It is certified that error appears in the above-identified patent and that said Letters Patent is hereby corrected as shown below:

On the cover page item:

[22] PCT Filed: Sep. 26, 1991

Signed and Sealed this

Twenty-ninth Day of November, 1994

*Attest:*

BRUCE LEHMAN

*Attesting Officer*

*Commissioner of Patents and Trademarks*